US009784099B2

(12) United States Patent
Kale et al.

(10) Patent No.: US 9,784,099 B2
(45) Date of Patent: Oct. 10, 2017

(54) PROBABILISTIC DETERMINATION OF HEALTH PROGNOSTICS FOR SELECTION AND MANAGEMENT OF TOOLS IN A DOWNHOLE ENVIRONMENT

(71) Applicants: Amit Anand Kale, Spring, TX (US); Troy A. Falgout, Kingwood, TX (US); David Burhoe, Spring, TX (US); Ludger E. Heuermann-Kuehn, Kingwood, TX (US); Richard Yao, The Woodlands, TX (US); Albert A. Alexy, Katy, TX (US); Paul A. Lowson, Houston, TX (US); Thomas Nguyen, Richmond, TX (US); Otto N. Fanini, Houston, TX (US)

(72) Inventors: Amit Anand Kale, Spring, TX (US); Troy A. Falgout, Kingwood, TX (US); David Burhoe, Spring, TX (US); Ludger E. Heuermann-Kuehn, Kingwood, TX (US); Richard Yao, The Woodlands, TX (US); Albert A. Alexy, Katy, TX (US); Paul A. Lowson, Houston, TX (US); Thomas Nguyen, Richmond, TX (US); Otto N. Fanini, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 595 days.

(21) Appl. No.: 14/132,510

(22) Filed: Dec. 18, 2013

(65) Prior Publication Data

US 2015/0167454 A1 Jun. 18, 2015

(51) Int. Cl.

| | |
|---|---|
| ***G01V 1/40*** | (2006.01) |
| ***E21B 49/00*** | (2006.01) |
| ***E21B 47/12*** | (2012.01) |

(52) U.S. Cl.

CPC ..... *E21B 49/003* (2013.01); *E21B 47/124* (2013.01)

(58) Field of Classification Search

CPC ..... E21B 49/003; E21B 47/124; E21B 47/00

(Continued)

(56) References Cited

U.S. PATENT DOCUMENTS 5,251,144 A 10/1993 Ramamurthi
5,803,186 A 9/1998 Berger et al.

(Continued)

OTHER PUBLICATIONS

Kale et al., "A Probabilistic Approach for Reliability and Life Prediction of Electronics in Drilling and Evaluation Tools" Annual Conference of the Prognostics and Health Management Society, 2014, pp. 1-20.

(Continued)

*Primary Examiner* — Stephanie Bloss

(74) *Attorney, Agent, or Firm* — Cantor Colburn LLP

(57) ABSTRACT

A system and method to determine health prognostics for selection and management of a tool for deployment in a downhole environment are described. The system includes a database to store life cycle information of the tool, the life cycle information including environmental and operational parameters associated with use of the tool. The system also includes a memory device to store statistical equations to determine the health prognostics of the tool, and a processor to calibrate the statistical equations and build a time-to-failure model of the tool based on a first portion of the life cycle information in the database.

18 Claims, 4 Drawing Sheets

(58) Field of Classification Search
USPC ..... 702/9
See application file for complete search history.

(56) References Cited

U.S. PATENT DOCUMENTS

| | | | | |
|---|---|---|---|---|
| 6,516,293 | B1 | 2/2003 | Huang et al. | |
| 6,732,052 | B2 | 5/2004 | MacDonald et al. | |
| 7,107,154 | B2 | 9/2006 | Ward | |
| 7,143,007 | B2 | 11/2006 | Long et al. | |
| 7,286,959 | B2 | 10/2007 | Steinke | |
| 7,451,639 | B2 | 11/2008 | Goldfine et al. | |
| 7,979,240 | B2 | 7/2011 | Fielder | |
| 8,200,442 | B2 | 6/2012 | Adams et al. | |
| 8,204,691 | B2 | 6/2012 | Deere | |
| 8,255,171 | B2 | 8/2012 | Balestra | |
| 8,274,399 | B2 | 9/2012 | Strachan et al. | |
| 8,453,764 | B2 | 6/2013 | Turner et al. | |
| 8,494,810 | B2 | 7/2013 | Goldfine et al. | |
| 2003/0168257 | A1* | 9/2003 | Aldred | E21B 49/003 175/24 |
| 2005/0197813 | A1* | 9/2005 | Grayson | E21B 47/00 703/10 |
| 2007/0239407 | A1 | 10/2007 | Goldfine et al. | |
| 2009/0299654 | A1* | 12/2009 | Garvey | E21B 41/00 702/34 |
| 2010/0042327 | A1* | 2/2010 | Garvey | E21B 47/00 702/11 |
| 2011/0125419 | A1* | 5/2011 | Bechhoefer | F03D 7/047 702/34 |
| 2011/0174541 | A1 | 7/2011 | Strachan et al. | |
| 2011/0196593 | A1* | 8/2011 | Jiang | F02C 9/00 701/100 |
| 2012/0016589 | A1 | 1/2012 | Li et al. | |
| 2012/0084008 | A1 | 4/2012 | Zhan et al. | |
| 2012/0118637 | A1 | 5/2012 | Wang et al. | |
| 2012/0316787 | A1 | 12/2012 | Moran et al. | |

OTHER PUBLICATIONS

Bailey et al., "Reliability Analysis for Power Electronics Modules", IEEE 30th International Spring Seminar on Electronics Technology, 2007, pp. 1-6.

Baker Hughes Incorporated "Repair and Maintenance Return Policy for Printed Circuit Board Assemblies", Document RM-002, Revision B, 2010, pp. 1-17.

Baker Hughes Incorporated, "OnTrak Repair & Maintenance Manual", OTK-10-0500-001 Rev N, 2008, pp. 1-35.

Barker et al., "PWB Solder Joint Life Calculations Under Thermal and Vibrational Loading", Journal of the IES, vol. 35, No. 1, Feb. 1992, pp. 17-25.

Boller et al., "Encyclopedia of Structural Health Monitoring", Pub. Date: Mar. 2009, ISBN-13: 9780470058220, pp. 1-30.

Born et al., "Marginal Checking—A Technique to Detect Incipient Failures", Proceedings of the IEEE Aerospace and Electronics Conference, May 22-26, 1989, pp. 1880-1886.

Chatterjee et al., "Fifty Years of Physics of Failure", Journal of Reliability Information Analysis Center, 2012, pp. 1-5.

Dasgupta, Abhijit "Failure Mechanism Models for Cyclic Fatigue", IEEE Transactions on Reliability, vol. 42, No. 4, Dec. 1993, pp. 548-555.

Duffek, Darrell, "Effect of Combined Thermal and Mechanical Loading on the Fatigue of Solder Joints", Master's Thesis 2004. University of Notre Dame, IN, pp. 1-65.

Evans et al., "A Framework for Reliability Modeling of Electronics", 1995 Proceedings Annual Reliability and Maintainability Symposium, 1995, pp. 144-151.

Garvey et al., "Pattern Recognition Based Remaining Useful Life Estimation of Bottom Hole Assembly Tools", SPE/IADC Drilling Conference and Exhibition, 2009, pp. 1-8.

Gingerich et al., "Reliable Electronics for High-Temperature Downhole Applications", SPE 56438, 1999, pp. 1-8.

Hu et al., "A Probabilistic Approach for Predicting Thermal Fatigue Life of Wire Bonding in Microelectronics", ASME Journal of Electronics Packaging, vol. 113, Sep. 1991, pp. 275-285.

International Preliminary Report on Patentability for PCT Application No. PCT/US2014/069088, dated Jun. 21, 2016, pp. 1-8.

Kalgren et al., "Application of Prognostic Health Management in Digital Electronic Systems", Aerospace Conference, IEEE 2007, pp. 1-9.

Lall et al., "Decision-Support Models for Thermo-Mechanical Reliability of Leadfree Flip-Chip Electronics in Extreme Environments", 2005 Electronic Components and Technology Conference, 2005, pp. 127-136.

Lall et al., "Statistical Pattern Recognition and Built-in Reliability Test for Feature Extraction and Health Monitoring of Electronics Under Shock Loads", IEEE Transactions on Components and Packaging Technologies, vol. 32, No. 3, Sep. 2009, pp. 600-616.

Lall, Pradeep "Tutorial: Temperature As an Input to Microelectronics-Reliability Models", IEEE Transactions on Reliability, vol. 45, No. 1, Mar. 1996, pp. 3-9.

Mirgkizoudi et al., "Reliability Testing of Electronic Packages in Harsh Environments", 12th Electronics Packaging Technology Conference, 2010, pp. 224-230.

Mishra et al., "In-situ Sensors for Product Reliability Monitoring", Proceedings of SPIE, vol. 4755, 2002, pp. 10-19.

Nasser et al., "Electronics Reliability Prognosis Through Material Modeling and Simulation", IEEE Aerospace Conference, 2006, pp. 1-7.

Normann et al., "Recent Advancements in High-Temperature, High-Reliability Electronics Will Alter Geothermal Exploration", Proceedings World Geothermal Congress, Apr. 24-29, 2005, pp. 1-5.

Osterman, Dr. Michael "We Still Have a Headache With Arrhenius", Electronics Cooling, vol. 7, No. 1, Feb. 2001, pp. 1-3.

Ridgetop Group, "Hot Carrier Injection (HCI) Die-Level Reliability Monitor", retrieved Oct. 12, 2016, retrieved from the Internet http://www.ridgetopgroup.com/products/semiconductors-for-critical-applications/sentinel-silicon-technology/hot-carrier-injection-hci/.

Shinohara et al., "Evaluation of Fatigue Life of Semiconductor Power Device by Power Cycle Test and Thermal Cycle Test Using Finite Element Analysis", Egineering, 2010, pp. 1006-1018.

Sutherland et al., "Prognostics, A New Look at Statistical Life Prediction for Condition-Based Maintenance", IEEE, 2003, pp. 1-6.

Vichare et al., "Environment and Usage Monitoring of Electronic Products for Health Assessment and Product Design", Quality Technology & Quantitative Management, vol. 4, No. 2, 2007, pp. 235-250.

Vichare, Nikhil M. "Prognosis and Health Management of Electronics by Utilizing Environmental and Usage Loads", Doctoral Thesis 2006, University of Maryland, College Park, pp. 1-166.

Vijayaragavan, Niranjan "Physics of Failure based Reliability Assessment of Printed Circuit Boards used in Permanent Downhole Monitoring Sensor Gauges", Master's Thesis 2003, University of Maryland, College Park, pp. 1-46.

Wassell et al., "Method of Establishing Vibration Limits and Determining Accumulative Vibration Damage in Drilling Tools", SPE Annual Technical Conference and Exhibition, Sep. 2010, pp. 1-10.

White et al., "Microelectronics Reliability: Physics-of-Failure Based Modeling and Lifetime Evaluation", NASA Joint Propulsion Laboratory Report, Project No. 102197, 2008, pp. 1-216.

Wong, Kam L. "A New Framework for Part Failure-Rate Prediction Models", IEEE Transactions on Reliability, vol. 14, No. 1, Mar. 1995, pp. 139-146.

Young et al., "Failure Mechanism Models for Electromigration", IEEE Transactions on Reliability, vol. 43, No. 2, Jun. 1994, pp. 186-192.

Zhang et al., "A Hybrid Prognostics and Health Management Approach for Condition-Based Maintenance", IEEE International Conference on Industrial Engineering and Engineering Management, 2009, pp. 1-5.

Zhang et al., "Model uncertainty and Bayesian updating in reliability-based inspection", Structural Safety, 2000, pp. 145-160.

(56) References Cited

OTHER PUBLICATIONS

Lall et al., "Influence of Temperature on Microelectronics and System Reliability", CRC Press, New York, NY, 1997, pp. 1-12, 13-100, 101-154, 155-168, 169-182, Chapters 7 and 8, and 257-292.
Pecht et al., "Guidebook for Managing Silicon Chip Reliability", CRC Press, Boca Raton, FL, 1999, pp. 3-6, 7-12, 13-18, 19-24, 25-30, 31-36, 37-40, 41-44, 49-60, 183-194 and 199-212.

* cited by examiner

330

PROBABILISTIC DETERMINATION OF HEALTH PROGNOSTICS FOR SELECTION AND MANAGEMENT OF TOOLS IN A DOWNHOLE ENVIRONMENT

BACKGROUND

Downhole exploration and production efforts require the deployment of a large number of tools. These tools include the drilling equipment and other devices directly involved in the effort as well as sensors and measurement systems that provide information about the downhole environment. When one or more of the tools malfunctions during operation, the entire drilling or production effort may need to be halted while a repair or replacement is completed.

SUMMARY

According to an aspect of the invention, a system to determine health prognostics for selection and management of a tool for deployment in a downhole environment includes a database configured to store life cycle information of the tool, the life cycle information including environmental and operational parameters associated with use of the tool; a memory device configured to store statistical equations to determine the health prognostics of the tool; and a processor configured to calibrate the statistical equations and build a time-to-failure model of the tool based on a first portion of the life cycle information in the database.

According to another aspect of the invention, a method to determine health prognostics for selection and management of a tool for deployment in a downhole environment includes storing, in a database, life cycle information of the tool, the life cycle information including environmental and operational parameters associated with use of the tool; storing, in a memory device, statistical equations to determine the health prognostics of the tool; and calibrating, using a processor, the statistical equations based on a first portion of the life cycle information and building a time-to-failure model of the tool.

BRIEF DESCRIPTION OF THE DRAWINGS

Referring now to the drawings wherein like elements are numbered alike in the several Figures.

DETAILED DESCRIPTION

As noted above, the malfunction of a downhole tool during an exploration or production effort can be costly in terms of the time and related expense related to repair or replacement. Embodiments of the system and method detailed herein relate to the development of calibrated time to failure models that facilitate tool selection and management for a downhole project.

Figure 1:
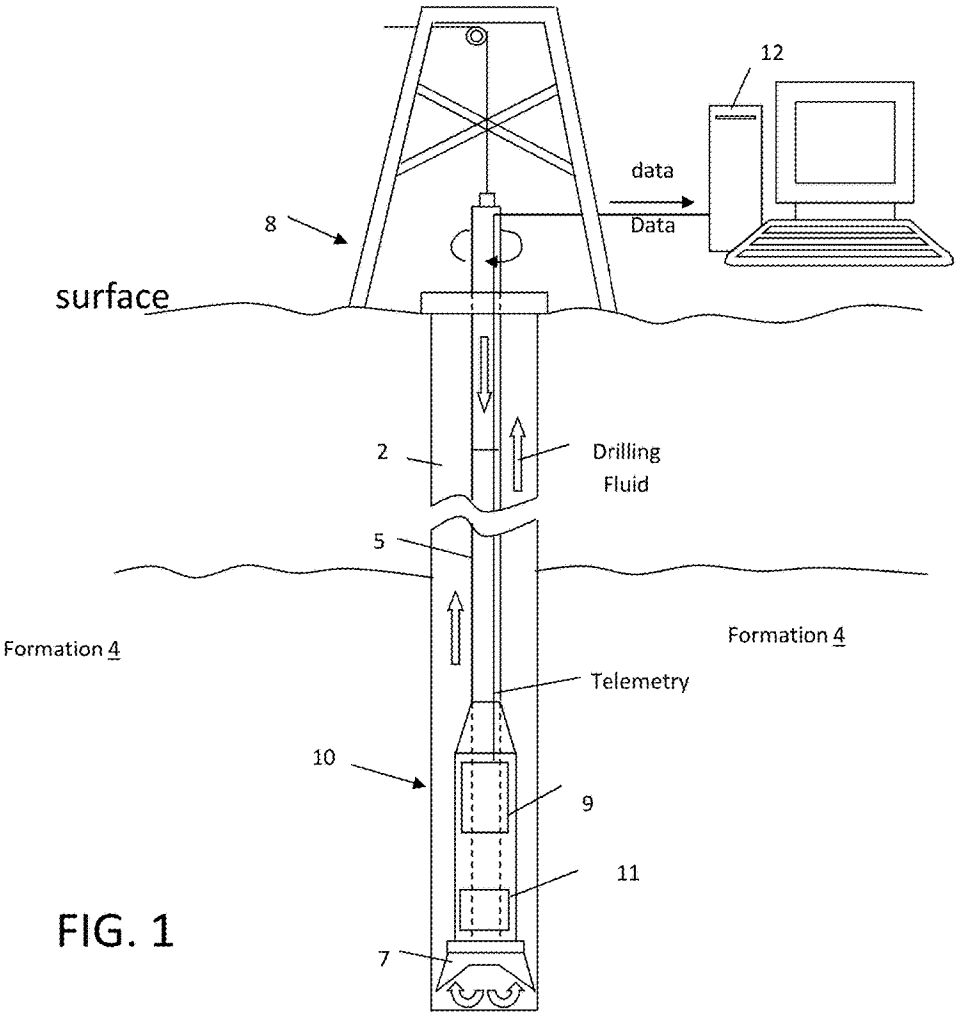
FIG. 1 is a cross-sectional view of a downhole system according to an embodiment of the invention.
Figure 2:
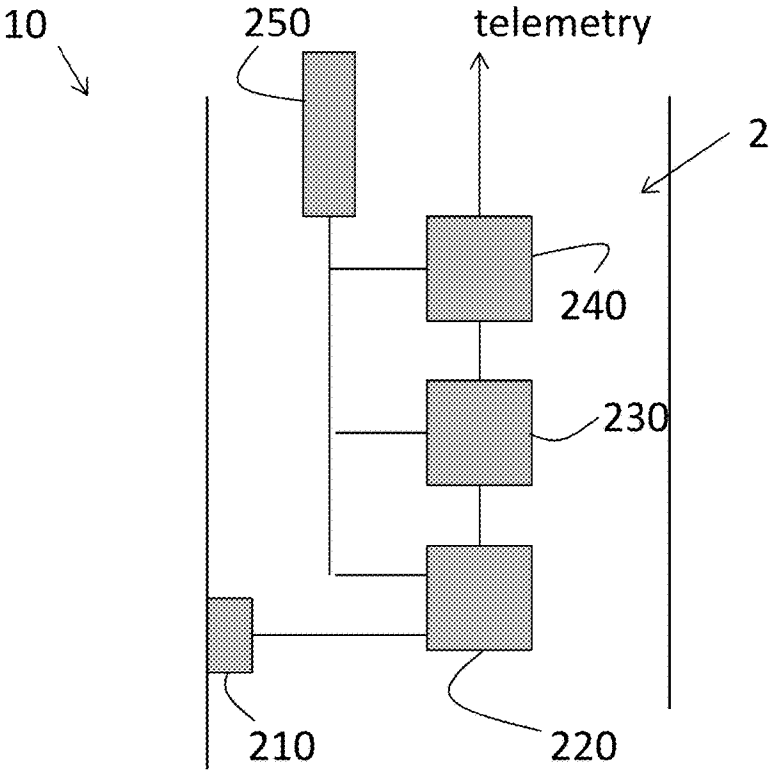
FIG. 2 is a block diagram of exemplary downhole tools according to an embodiment of the invention.

FIG. 1 is a cross-sectional view of a downhole system according to an embodiment of the invention. While the system may operate in any subsurface environment, FIG. 1 shows downhole tools 10 disposed in a borehole 2 penetrating the earth. The downhole tools 10 are disposed in the borehole 2 at a distal end of a carrier 5, as shown in FIG. 1, or in communication with the borehole 2, as shown in FIG. 2. The downhole tools 10 may include measurement tools 11 and downhole electronics 9 configured to perform one or more types of measurements in an embodiment known as Logging-While-Drilling (LWD) or Measurement-While-Drilling (MWD). According to the LWD/MWD embodiment, the carrier 5 is a drill string. The measurements may include measurements related to drill string operation, for example. A drilling rig 8 is configured to conduct drilling operations such as rotating the drill string and, thus, the drill bit 7. The drilling rig 8 also pumps drilling fluid through the drill string in order to lubricate the drill bit 7 and flush cuttings from the borehole 2. Raw data and/or information processed by the downhole electronics 9 may be telemetered to the surface for additional processing or display by a computing system 12. Drilling control signals may be generated by the computing system 12 and conveyed downhole or may be generated within the downhole electronics 9 or by a combination of the two according to embodiments of the invention. The downhole electronics 9 and the computing system 12 may each include one or more processors and one or more memory devices. In alternate embodiments, the carrier 5 may be an armored wireline used in wireline logging. The borehole 2 may be vertical in some or all portions.

FIG. 2 is a block diagram of exemplary downhole tools 10 according to an embodiment of the invention. The downhole tools 10 shown in FIG. 2 are exemplary measurement tools 11 and downhole electronics 9 discussed above with reference to FIG. 1 and include an all-in-one combination sensor 210. The combination sensor 210 may be used to determine weight-on-bit (WoB), torque-on-bit (ToB), pressure, and temperature. The combination sensor 210 may use sputtered strain gauges or other thin-film sensor technology and may be surface-mounted (welded onto an outer surface pocket) to subs, shanks, pipes, or other components on a drill stream. The combination sensor 210 compensates for downhole hydraulic pressure (hoop stress) automatically. Another exemplary one of the downhole tools 10 is an environmental tool 220 that may obtain vibration and temperature, for example, and store the values over time in a memory module of the environmental tool 220. The environmental tool 220 facilitates the use of one measurement device rather than a measurement device specific to each of the downhole tools 10. The environmental tool 220 may also record information about the number of power cycles for each tool. The memory module of the environmental tool 220 may also store the combination sensor 210 information, as well as information from other sensors and measurement tools 11 and may convey all of the information to a controller 230, which may provide some or all of the information to a communication module 240 for telemetry to the surface (e.g., surface computing system 12). A power supply 250 supplies each of the environmental took, controller, and communication module 240. The information from other sensors (from combination sensor 210 or other measurements tools 11) may be received at the environmental tool 220 in digital or analog form. When the information is in analog form, the environmental tool 220 may pre-condition, filter, pre-amplify, and convert the analog signals to digital representations (in binary coded form, for example). The environmental tool 220 may be implemented as a multi-chip module, printed circuit board assembly, or hybrid electronic package, for example, but is not limited in its packaging or other aspects of its implementation. Exemplary data acquired and telemetered by the environmental tool 220 includes: accelerometer data (e.g., x, y, and z tri-dimensionally oriented data), angular acceleration and torsional vibration data (optionally derived from the accelerometer data), borehole pressure, borehole temperature, tool internal temperature, bottom hole assembly torque and associated drill string torque, bottom hole assembly WoB and associated drill string WoB, vibration data in time or frequency domain from the accelerometer data, and a statistical representation or parameter computation of vibration data over a time interval (e.g., histograms, root-mean-square (RMS) values, vibration energy frequency spectrum distribution). The data processed (received, telemetered) by the environmental tool 220 may be time stamped with a real time clock or time code correlated to a real time clock. The time-stamped data may be correlated to depth at the surface (e.g., at the surface computing system 12). That is, the communication module 240 may stamp telemetry data with a real time clock time stamp prior to transmission. The deployment of all the devices of the system (e.g., drill bit 7) is based on the analysis described below, which relies at least in part on the information obtained and provided by the combination sensor 210 and environmental tool 220, according to various embodiments of the invention.

Figure 3:
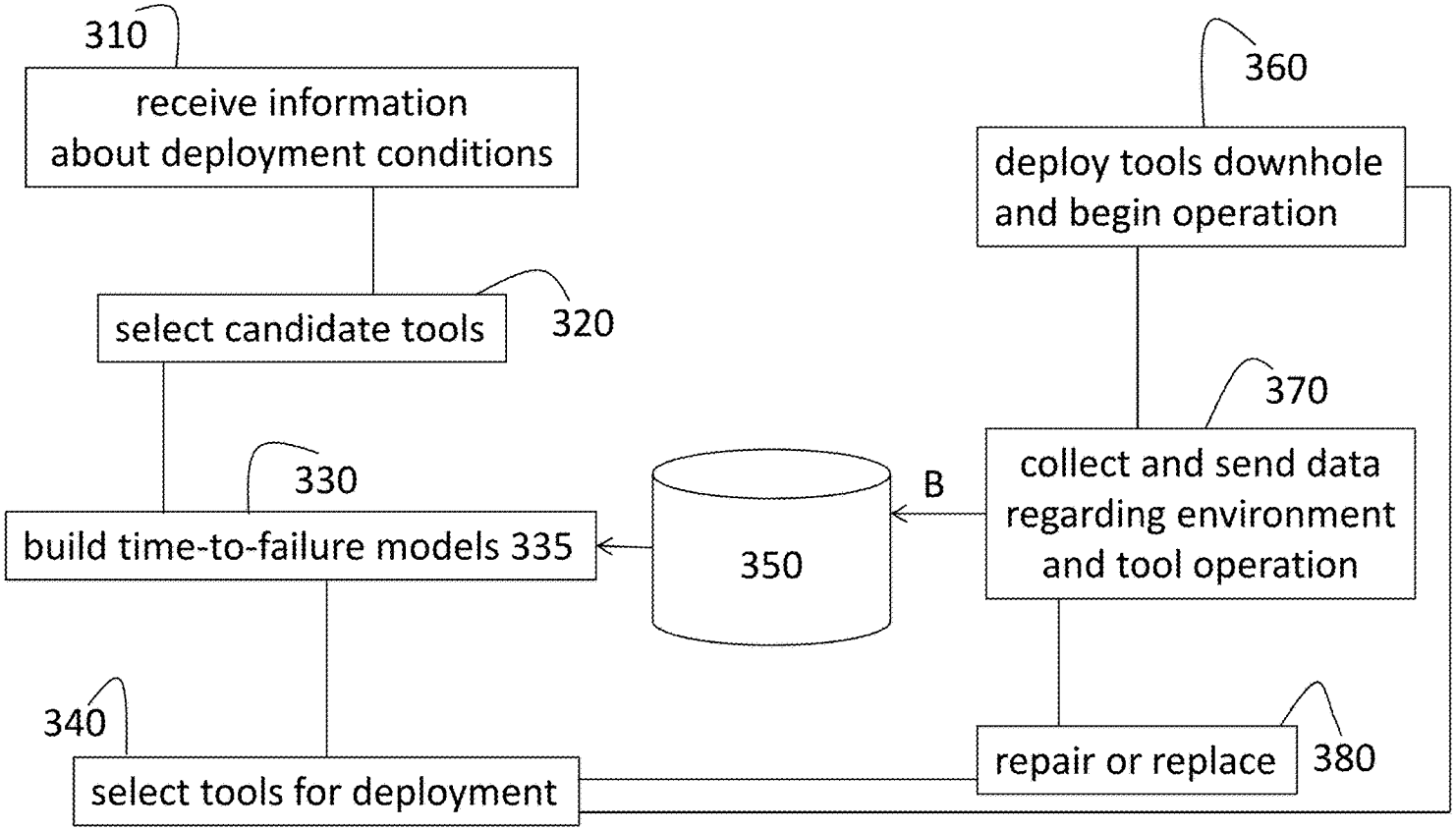
FIG. 3 is a process flow of a method of determining health prognostics to select and manage tools 10 for deployment downhole.

FIG. 3 is a process flow of a method of determining health prognostics to select and manage tools for deployment downhole. At block 310, receiving information about deployment conditions includes receiving information regarding the type of formation 4 (e.g., hardness of rock), average temperature and moisture expected, for example, in addition to information regarding length of time and other conditions specific to the effort planned at the deployment site. Receiving information at block 310 may further include receiving information about well path trajectory and associated drilling dynamics, which may be associated with anticipated vibration and drilling conditions based on history or model based prediction), reservoir layered three-dimensional models with subsurface position and directional coordinates (geoid structural description), reservoir geology description and relevant inputs for drilling operation and conditions, reservoir lithology based on past logging data and the reservoir geology model, reservoir pressure and temperature description with subsurface position and directional coordinates linked to a planned well path and past wells drilled in a target reservoir, and bottom hold assembly configuration (e.g., motor, steering, formation evaluation tools, directional tools, power generator tool, telemetry tool). At block 320, the process includes selecting candidate tools to be analyzed to determine whether they should be deployed in the specified deployment conditions. At block 330, building time-to-failure (TTF) models 335 is further discussed with reference to FIG. 4 below. Selecting tools for deployment at block 340 is based on the TTF models 335. The TTF models 335 use lifecycle tool information stored in a database 350 for each candidate tool. Deploying tools downohole and beginning operation at block 360 is based on the tool selection which, in turn, is based on the TTF models 335. Collecting and sending data regarding the environment and tool operation at block 370 includes collecting and sending failure analysis information and adds lifecycle tool information to the database 350. The information collected at block 370 may include, for example, inputs from field operations and reservoir managers and developers, downhole tools 10, the environmental tool 220, failure modes and processes independently identified from lab tests and confirmed with actual field Time to failure and failure mode accelerators (environmental conditions and drilling dynamics such as vibration, WoB, torque, torsion), dominant failure modes from failure analysis, and a fault tree process and relevant acceleration factors for proper time to failure modeling and prediction. The information collected at block 370 may additionally include lab test data and results along with root cause analysis involving failure, failure modes and mechanics, failure mechanisms and tree, failure acceleration factors driven by environment and correlated failure mechanism state of progression towards failure, time to failure measurements under lab controlled conditions obtained from lab tests simulating measured and characterized field operating conditions documented with field reservoir geology, lithology, and rock properties, drilling tools, and extended with indexed maps to equivalent subsurface coordinate regions with similar conditions for a multitude of drilling areas and environments of commercial interest. Based on this information and the TTF models 335, repairing or replacing tools at block 380 ensures operation with as few and as brief interruptions as possible.

Figure 4:
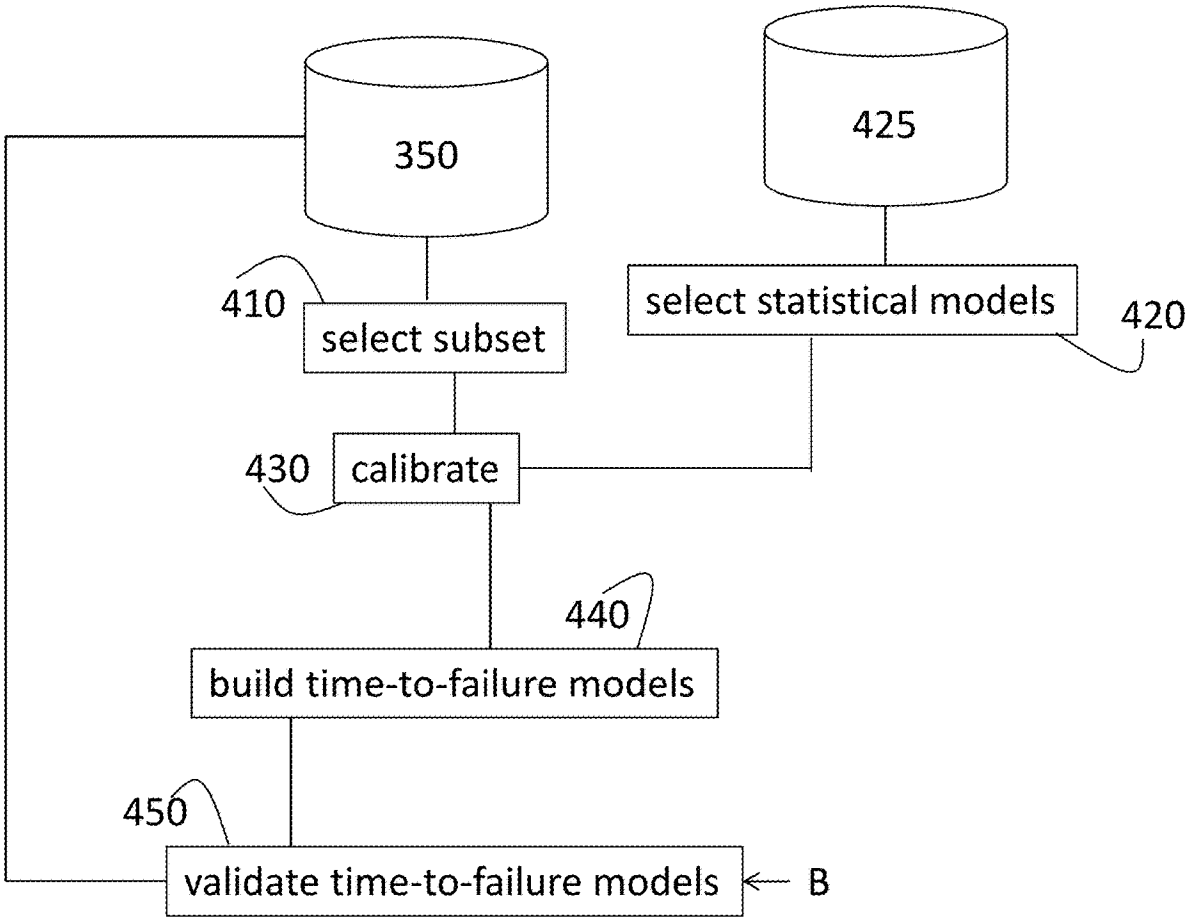
FIG. 4 is a process flow of a method of building time-to-failure models according to an embodiment of the invention.

FIG. 4 is a process flow of a method of building time-to-failure models 335 according to an embodiment of the invention. Each TTF model 335 corresponds with a downhole tool 10 to be checked as a candidate for deployment or managed during deployment. At block 410, the process includes selecting a subset of the lifecycle tool information for a candidate tool from the database 350. The information stored in the database 350 and the database 425 (discussed below) is an accumulated history such that the information may be added to and refined over time. The lifecycle tool information includes both environment and operating parameters. Thus, selecting the subset may include selecting, from among the available parameters, a subset of parameters that have a statistically significant affect (relatively) on the life of the tool. One or more algorithms (or, alternatively, laboratory experiments) may be used to quantify the impact of each parameter, alone and in combination with other parameters. That is, one or more factors may not be significant when acting alone but may be significant in the presence of other operating conditions (e.g., the statistical significance of stick slip may increase with the rotational speed of the drill 7,8). At block 420, selecting statistical models includes accessing a database 425 or memory device to select parameter estimation algorithms that include linear regression, maximum likelihood estimation, and classification models. These statistical models have unknown parameter values. At block 430, calibrating the statistical models includes determining the unknown parameter values and their statistical properties, namely the mean and standard deviation. The process of calibrating at block 430 to determine the unknown parameter values is performed iteratively and includes reweighting the subset of data selected at block 410 to obtain a best fit. At block 440, building the TTF models 335 includes developing statistical equations that best match the life of the corresponding downhole tool 10 and provide the lowest prediction variance (i.e., lowest spread between the worst case, best case, and average life of the downhole tool 10). Building the TTF models 335 is not a one-time process but, instead, may be done after each drilling run, for example, to dynamically select (re-select) the appropriate TTF models 335 using the Bayesian updating technique. At block 450, validating the TTF models 335 may be done using a subset (different than the subset chosen at block 410 to build the TTF models 335) of the lifecycle tool information from the database 350 or using measurement data collected in an on-going operation. For example, as an operation progresses and the conditions of the deployment conditions become more harsh, validating the TTF models 335 (block 450) using real-time or near-real time data and, as needed, re-building the TTF models 335 (block 440) may be performed.

Table 1 illustrates the type of output provided by the TTF models 335. The table may include cumulative temperature in Centigrade (C), cumulative lateral and stickslip root-mean-square acceleration (g_RMS), drill hours, and worst-case, predicted mean, and best-case life (in hours). Thus, a tool may be selected based on its worst-case life hours being sufficiently greater than the drill hours (already-used time) to accommodate an expected duration of an operation, for example.

TABLE 1

Exemplary TTF model 335 output.

| Cumulative Temperature C. | Cumulative Lateral (g_RMS) | Cumulative StickSlip (g_RMS) | Drill Hrs | Worst case life | Predicted mean life | Best case life |
|---|---|---|---|---|---|---|

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system to determine health prognostics for selection and management of a tool for deployment in a downhole environment, the system comprising;

a database configured to store life cycle information of the tool, the life cycle information including environmental and operational parameters associated with use of the tool;

a memory device configured to store statistical equations to determine the health prognostics of the tool; and a processor configured to calibrate the statistical equations and build a time-to-failure model of the tool based on a first portion of the life cycle information in the database and further configured to validate the time-to-failure model using a second portion of the life cycle information in the database, wherein validating refers to verifying an output of the time-to-failure model, and the tool is repaired or replaced according to the output of the time-to-failure model.

2. The system according to claim 1, wherein the processor is configured to select the tool for deployment based on the time-to-failure model.

3. The system according to claim 2, wherein the processor is configured to select the tool for deployment based on receiving information regarding an environment of the deployment.

4. The system according to claim 1, wherein the processor validates the time-to-failure model based on real-time data obtained from the tool.

5. The system according to claim 1, wherein the processor selects the first portion of the life cycle information based on quantifying which ones of the parameters affect the health prognostics of the tool more than others.

6. The system according to claim 1, wherein the system is configured to manage the tool during use based on calibrating the statistical equations and validating the time-to-failure model using life cycle information measured during the use.

7. The system according to claim 1, wherein the life cycle information includes an environmental profile including temperature and vibration provided by an environmental tool.

8. The system according to claim 1, wherein the life cycle information includes a number of power cycles of the tool.

9. The system according to claim 1, wherein the life cycle information is obtained with a combination sensor configured to measure weight-on-bit, torque-on-bit, pressure, and temperature.

10. A method to determine health prognostics for selection and management of a tool for deployment in a downhole environment, the method comprising:

storing, in a database, life cycle information of the tool, the life cycle information including environmental and operational parameters associated with use of the tool;

storing, in a memory device, statistical equations to determine the health prognostics of the tool;

calibrating, using a processor, the statistical equations based on a first portion of the life cycle information and building a time-to-failure model of the tool;

validating the time-to-failure model using a second portion of the life cycle information in the database, wherein the validating refers to verifying an output of the time-to-failure model; and repairing or replacing the tool according to the output of the time-to-failure model.

11. The method according to claim 10, further comprising the processor selecting the tool for deployment based on the time-to-failure model.

12. The method according to claim 11, further comprising the processor selecting the tool for deployment based on receiving information regarding an environment of the deployment.

13. The method according to claim 10, further comprising the processor validating the time-to-failure model based on real-time data obtained from the tool.

14. The method according to claim 10, further comprising the processor selecting the first portion of the life cycle information based on quantifying which ones of the parameters affect the health prognostics of the tool more than others.

15. The method according to claim 10, further comprising managing the tool during use based on calibrating the statistical equations and validating the time-to-failure model with life cycle information measured during the use.

16. The method according to claim 10, further comprising measuring an environmental profile including temperature and vibration provided by an environmental tool for inclusion in the life cycle information.

17. The method according to claim 10, further comprising measuring a number of power cycles of the tool for inclusion in the life cycle information.

18. The method according to claim 10, further comprising measuring weight-on-bit, torque-on-bit, pressure, and temperature using a combination sensor as the life cycle information.

* * * * *